US012465837B1

(12) United States Patent
Bidney

(10) Patent No.: US 12,465,837 B1
(45) Date of Patent: Nov. 11, 2025

(54) PUTTING ALIGNMENT SYSTEM AND METHOD

(71) Applicant: Michael Bidney, Eden Prairie, MN (US)

(72) Inventor: Michael Bidney, Eden Prairie, MN (US)

( * ) Notice: Subject to any disclaimer, the term of this patent is extended or adjusted under 35 U.S.C. 154(b) by 0 days.

(21) Appl. No.: 18/401,927

(22) Filed: Jan. 2, 2024

Related U.S. Application Data

(60) Provisional application No. 63/437,066, filed on Jan. 4, 2023.

(51) Int. Cl.
*A63B 69/36* (2006.01)
*A63B 71/06* (2006.01)

(52) U.S. Cl.
CPC ..... *A63B 69/3676* (2013.01); *A63B 71/0622* (2013.01); *A63B 2071/0694* (2013.01); *A63B 2220/18* (2013.01)

(58) Field of Classification Search
CPC ..... A63B 69/3676; A63B 71/0622; A63B 2071/0694; A63B 2220/18; A63B 57/00; A63B 57/30
See application file for complete search history.

(56) References Cited

U.S. PATENT DOCUMENTS

| | | | | | |
|---|---|---|---|---|---|
| 5,437,446 | A * | 8/1995 | Youngkin | A63B 57/353 | 473/409 |
| D583,893 | S * | 12/2008 | Ruff | D21/794 | |
| D614,253 | S * | 4/2010 | Hadley | D21/791 | |
| 7,988,572 | B1 * | 8/2011 | Sweeney | A63B 69/3676 | 473/407 |
| D661,761 | S * | 6/2012 | Cameron | D21/794 | |
| D669,551 | S * | 10/2012 | Perez | D21/794 | |
| 10,058,760 | B1 * | 8/2018 | McWilliam | A63B 69/3682 | |
| D859,556 | S * | 9/2019 | Kumpis | D21/794 | |
| D947,305 | S * | 3/2022 | Leposky | D21/794 | |
| 12,083,392 | B2 * | 9/2024 | McLoughlin | A63B 69/3676 | |
| D1,055,190 | S * | 12/2024 | Tucker | D21/793 | |
| 2009/0305817 | A1 * | 12/2009 | Cameron | A63B 59/50 | 473/406 |
| 2009/0305818 | A1 * | 12/2009 | Cameron | A63B 57/353 | 473/406 |
| 2010/0222160 | A1 * | 9/2010 | Williams | A63B 57/353 | 473/409 |
| 2010/0222161 | A1 * | 9/2010 | Williams | A63B 69/3676 | 473/409 |
| 2013/0260920 | A1 * | 10/2013 | Goldsmith | A63B 57/353 | 473/404 |

* cited by examiner

*Primary Examiner* — Steven B Wong
(74) *Attorney, Agent, or Firm* — Spencer Fane, LLP

(57) ABSTRACT

A putting alignment device having a recess that is adapted to receive a portion of a golf ball. The putting alignment device also includes a plurality of angular indicia.

10 Claims, 4 Drawing Sheets

PUTTING ALIGNMENT SYSTEM AND METHOD

REFERENCE TO RELATED APPLICATION

This application claims priority to Provisional Applic. No. 63/437,066, filed Jan. 4, 2023, the contents of which are incorporated herein by reference.

FIELD OF THE INVENTION

The invention relates generally to putting a golf ball. More particularly, the invention relates to a system and method for determining the amount of break and then aligning the putt aligning a put and then putting a golf ball.

BACKGROUND OF THE INVENTION

One significant challenge for a person to get a better score while golfing is to putt more accurately. Even though there is a significantly greater distance between a golf tee area and a golf green than the distance from an edge of the golf green to the cup, it can take more strokes to putt the golf ball into the cup than it took to hit the golf ball from the golf tee area to the golf green. Particularly for skilled golfers, accurately putting plays a significant in differentiating between a poor golf score and a good golf score.

SUMMARY OF THE INVENTION

The invention of the global positioning system allowed for an object (automobile), to travel across varied terrain (roads and interstates) exactly to a specific destination. In this example there are innumerable objects, terrain, and destinations. The system and method allow for a simplified way of directing the driver to the final destination electronically in a series of simplified steps.

Similarly, the system and method of delivering a golf ball to its final destination, the hole, includes a series of simplifications, novel approaches to terrain measurement and novel designs for setting direction to the ball.

This system and method of this invention is new to the game of golf and results in a novel and comprehensive approach to green reading never seen before. Initially, this system and method will be available to the user in a series of booklets and specifically designed putting alignment device. This system and method will also be used in a mobile application for users who prefer electronic usage and for training purposes.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

DETAILED DESCRIPTION OF THE INVENTION

An embodiment of the invention is directed to a system and a method for accurately putting a golf ball. The invention generally includes:

1. A putting alignment device that utilizes trigonometry to enable a golfer to aim exactly at a specific point.
2. A system and method for measuring speed of terrain.
3. A design for displaying terrain orientation.
4. A system and method for applying terrain mathematics for efficient user experience.
5. A system and method for precision aiming of ball.

Figure 1:
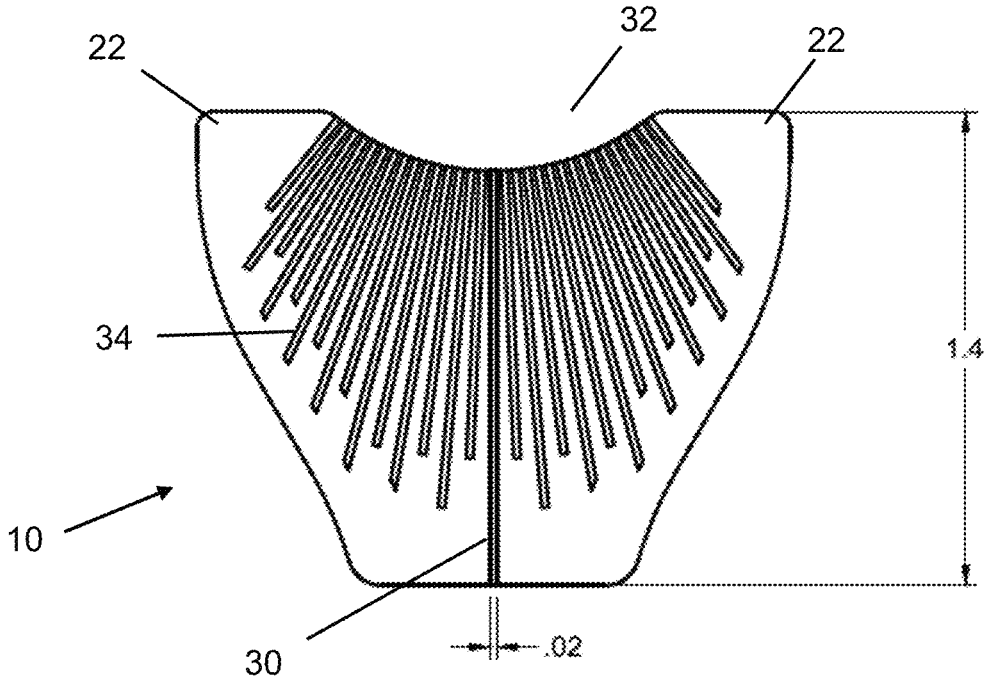
FIG. 1 is a top view of a putting alignment device according to an embodiment of the invention.
Figure 2:
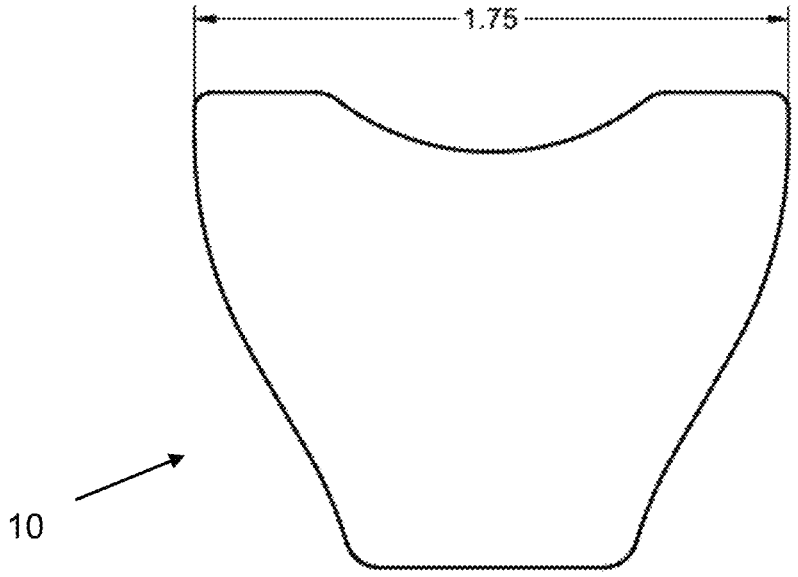
FIG. 2 is a bottom view of the putting alignment device of FIG. 1.
Figure 3:
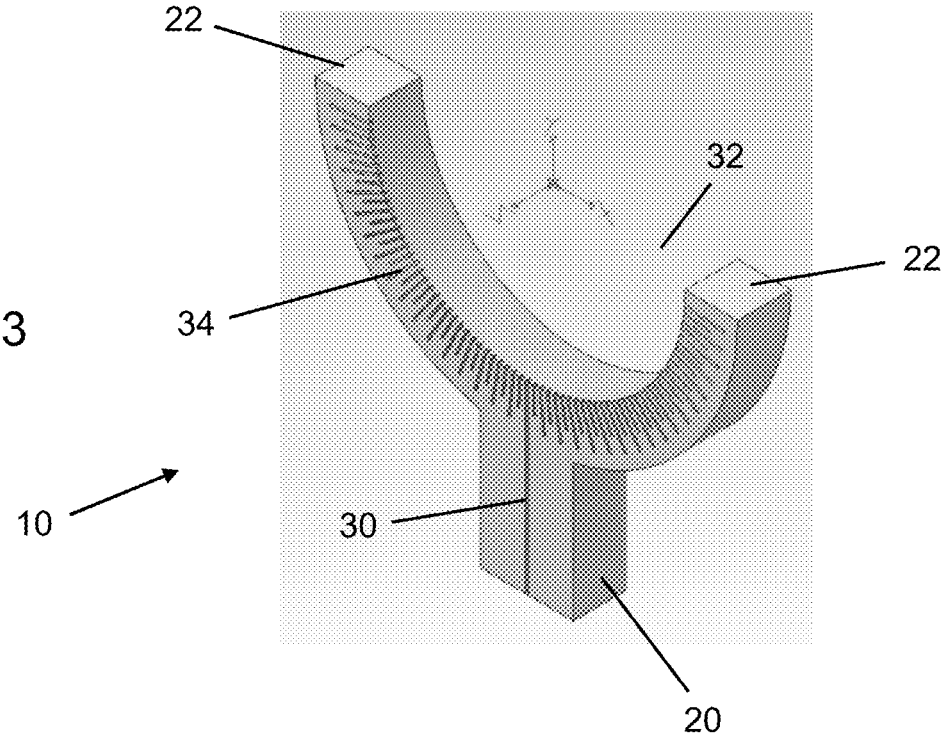
FIG. 3 is a perspective view of a putting alignment device according to another embodiment of the invention.
Figure 5:
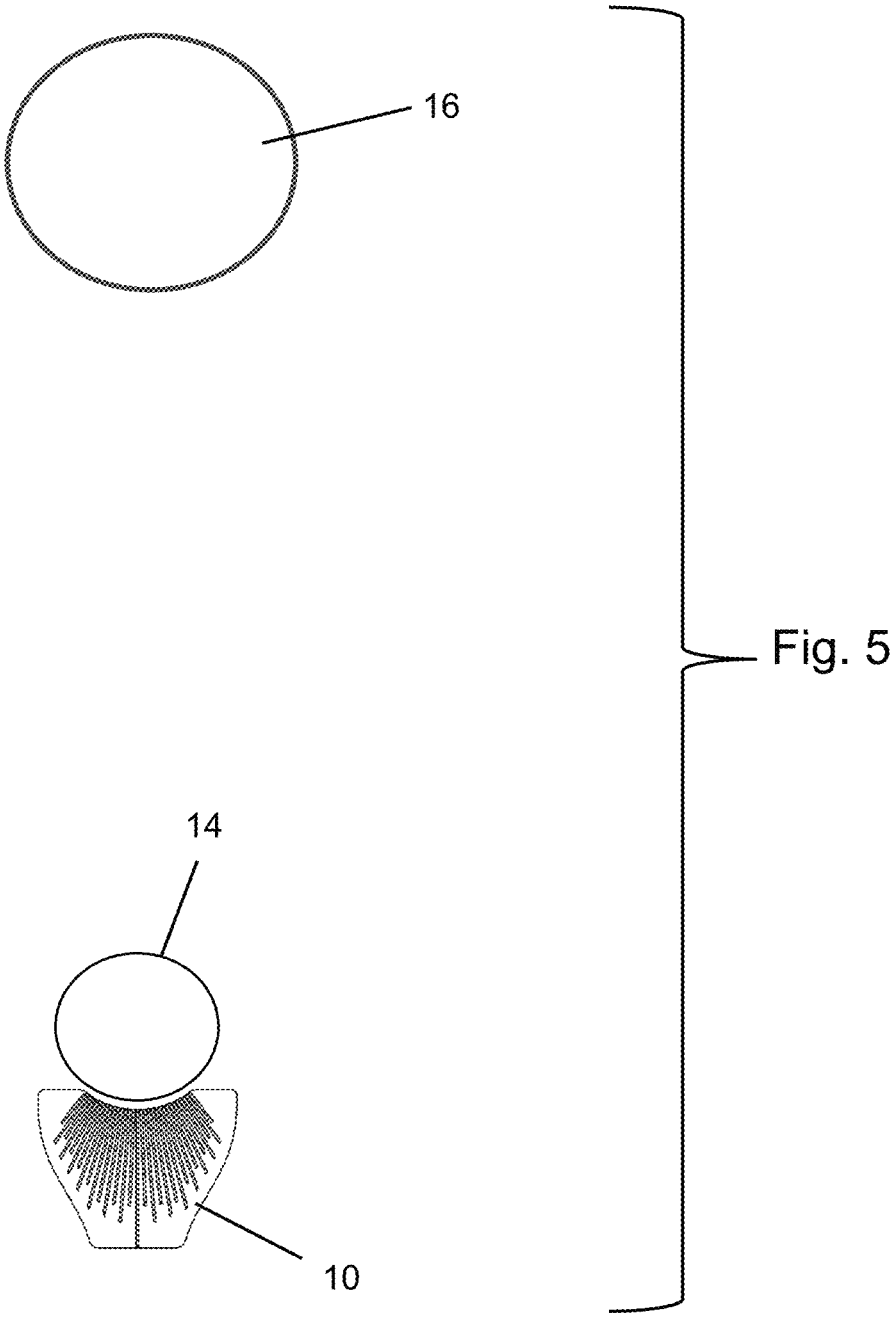
FIG. 5 is a top view of the putting alignment device used to align a putt of a golf ball to a hole on a green.

Specifically Designed Device Using Trigonometry to Allow User to Aim Exactly at a Specific Point A cornerstone of the invention is a novel putting alignment device at illustrated at 10 in FIGS. 1 and 2 or in FIG. 3. The putting alignment device 10 generally includes an elongated section 20 that extends away from a pair of semi-circular arms 22. The semi-circular arms 22 define a semi-circular recess 32 in which a portion of a golf ball 14 may be positioned as illustrated in FIG. 5.

The elongated section 20 includes an alignment line 30 on a surface thereof. In certain embodiments, the alignment line 30 is intermediate opposite sides of the elongated section 20 and extends from a proximal end of the elongated section 20 to the semi-circular recess 32.

The elongated section 20 is sufficiently long to enable a person using the putting alignment device 10 to see the alignment line 30 and thereby use the alignment line 30 as described in more detail herein.

The putting alignment device 10 includes angular indicia 34 at certain increments. In certain embodiments, the angular indicia 34 are positioned to 90 degrees on opposite sides of the alignment line 30. In one such embodiment, the angular indicia 34 are at 5 degree increments.

As illustrated in FIGS. 1 and 3, some of the angular indicia 34 may have different lengths. For example, the angular indicia 34 may alternate between long and short. Such a configuration may enhance the ability of the person to count the angular indicia 34 when determining the angle.

While not illustrated, it is possible for numbers to be used instead of or in addition to the angular indicia 34 to facilitate the person using the putting alignment device 10 to accurately determine the angle.

Using the slope formula set forth below, it is possible with a high level of precision to calculate the slope from a specific distance from the center of the cup at any distance from the cup.

$$m = \tan\theta = \Delta y/\Delta x = (y2 - y1)/(x2 - x1)$$

For example, one interval from the centerline is a certain number of degrees, when the putting alignment device 10 is aimed at the center of the cup 16. For every foot of distance in between the putting alignment device 10 and the cup 16, the aim will move an exactly proportional distance from the center. Because of this mathematical certainty, the invention can accurately aim the golf ball 14 with a high degree of precision at any distance to the cup 14 to any aiming target measured from the cup 16.

System and Method for Measuring Speed of Terrain

One requirement of measuring the break of the golf ball 14 across the green surface is being able to ascertain a relative speed of the green surface. Prior to this invention, green speeds have been measured using a method such as is described in U.S. Pat. No. 6,860,139.

While an excellent addition to the game of golf, this method of reading green speeds is usually performed by the course superintendent or the club professional. It requires the golfer to check in with one or the other before every round to get an exact green speed for the day.

The method of determining the relative speed of the green surface using this invention is dependent on the ability to know the expected break of a putt across various slopes and allows the golfer to determine the speed on their own. The method is as follows:

1. The golfer will find a spot on a practice green that has a length of about 10 feet.
2. Golfer will determine the slope of the green in that area using a measuring device, using the golfer's feet or using a mobile application.
3. Next, the golfer will place a tee in the ground and ascertain the X, or cross putt 90 degrees to the S, or straight uphill putt.
4. Golfer will place the golf ball 10 feet from the tee at the X mark.
5. Next golfer will putt the ball directly at the tee with just enough speed to reach the target.
6. Golfer will measure distance between tee and ball and refer to the chart set forth below in Table 1.

TABLE 1

| | Stimp | | | | |
|---|---|---|---|---|---|
| Slope | 8 Inch Break | 9 Inch Break | 10 Inch Break | 11 Inch Break | 12 Inch Break |
| 1 | 3 | 4 | 5 | 6 | 7 |
| 2 | 6 | 8 | 10 | 12 | 14 |
| 3 | 9 | 12 | 15 | 18 | 21 |

This charting will show the golfer the stimp of the green based on how much the practice putt broke away from the tee. This is a critical step to being able to read the green breaks properly.

Design for Displaying Terrain Orientation

Figure 4:
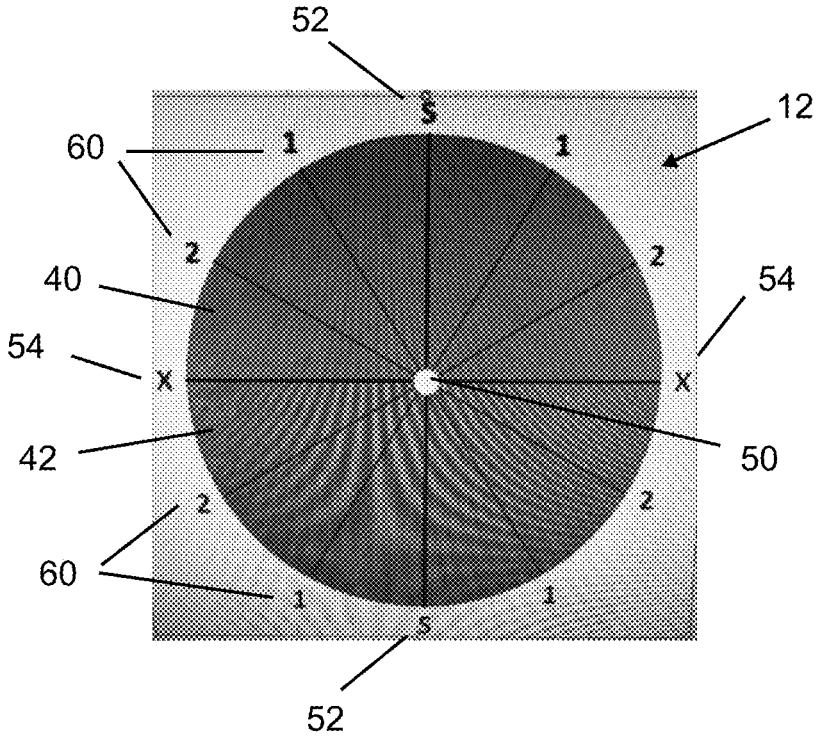
FIG. 4 is a top view of a green orientation angle evaluation device.

The critical design elements of the terrain orientation display are as follows:

1. Underlying circular area to guide user orientation around the golf hole such as using the device 12 illustrated in FIG. 4, the center of which is identified as 50.
2. Red section 40 depicts a "downhill" section of the putt.
3. Green section 42 depicts a "uphill" section of the putt.
4. "S" indicators 52 at the top and bottom of the circle depicting the "straight" putt, or the fall line.
5. "X" indicators 54, indicating the putt 90 degrees to the straight putt, or fall line
6. The "S" indicators 52 and the "X" indicators 54 divide the circle into four quadrants.
7. Each of the quadrants may include numeric indicators 1-5 60.
8. Jr Golf/beginner design will have 1, 2. (Two increments per quadrant)
9. Intermediate design will have 1, 2, 3. (Three increments per quadrant)
10. Professional design will have 1, 2, 3, 4, 5. (Five increments per quadrant)

System and Method for Applying Terrain Mathematics for Efficient User Experience Previously to the system and method of green reading and ball aiming of this invention, there existed extremely complicated mathematics that prohibited the golfer from an analytical approach to green reading.

For many people the math is difficult, time consuming and difficult to apply consistently from shot to shot. For example, once the golfer determines the orientation of the golf ball to the hole, many calculations must be considered such as:

1. Is the putt uphill or downhill?
2. What is the orientation of the ball to the hole?
3. What is the slope of the green?
4. What is the angle of the ball across the slope of the green?
5. What is the "stimp" or speed of the green?
6. What direction is the putt breaking?

After all these factors are considered and processed mentally, a certain amount of break is "estimated" by the golfer and then the golfer estimates his/her aim toward that point.

This invention has eliminated the estimating of the inches of break in the putt and the guesstimating if the golf ball is correctly aimed at the calculated point. The charting system of this invention uses an internal calculation to output a specific increment of aim for each slope and orientation of the putt such as set forth in Table 2.

TABLE 2

| 10 Stimp | Slope 1 | Slope 2 | Slope 3 | Slope 4 | Slope 5 |
|---|---|---|---|---|---|
| 1 | 1.4 | 2.9 | 4.2 | 5.6 | 6.9 |
| 2 | 1.7 | 3.3 | 4.9 | 6.5 | 8.0 |
| 90 | 1.0 | 1.9 | 2.9 | 3.8 | 4.7 |
| 2 | 0.6 | 1.3 | 1.9 | 2.5 | 3.2 |
| 1 | 0.3 | 0.6 | 1.0 | 1.3 | 1.6 |

System and Method for Precision Aiming of Ball

Figure 6:
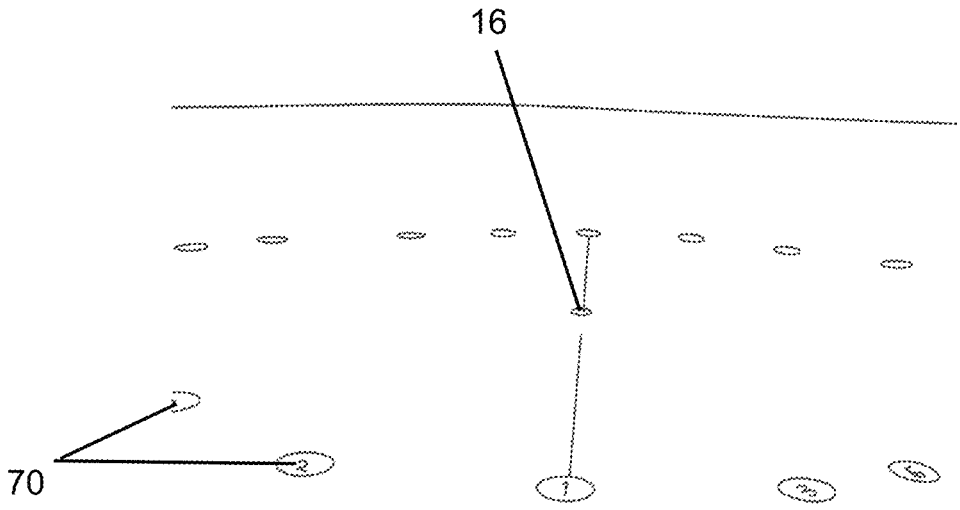
FIG. 6 is an illustration of markers placed on the green in a circular pattern.
Figure 7:
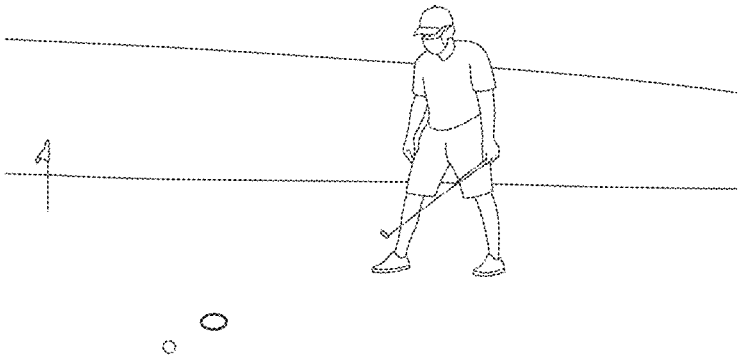
FIG. 7 is an illustration of a person with feet apart on the green.

Now all the tools are laid out to detail the system and method of exactly aiming a golf ball across varied terrain to its final destination, the hole. The steps in utilizing the invention are as follows:

1. Determine the green speed (stimp).
2. Place the putting alignment device 10 adjacent to the golf ball 14 so that the elongated section 20 is directed at the hole 16 as illustrated in FIG. 5.
3. Determine the orientation of the ball to the hole using the design for displaying terrain orientation. Moving in a circular motion at a relatively constant distance from the hole 16 determine where approximately equal weight is sensed on both feet. This is the location from which there is a straight put to the hole 16. When learning the invention, markers 70 may be placed on the green in a circular pattern around the hole 16 as illustrated in FIG. 6. Such a process may enhance the ability of the golfer to learn how to sense that there is approximately equal weight on both of the golfer's feet. The line through the cup at this location is designated S 52 in FIG. 4. Perpendicular to line S is the X axis 54. The uphill semi-circle is designated as the red zone 40 and the downhill semi-circle is designated as the green zone 42. Next, the golfer moves along the circle from the line S towards the line X by stepping from feet together to feet apart (illustrated in FIG. 7) to determine the zone at which the golf ball 14 is located such as identified with numbers 60 in FIG. 4.

4. Determine the slope of the green in between the golf ball 14 and the hole 16 such as by reviewing a chart of the green (such as Greenbooks by Golflogix).
5. Using the chart set forth in Table 2, determine the angle of the putt. There will be a separate similar table for each stimp reading.
6. Align the golf ball at the angle determined from Table 2 using the angular increments on the putting alignment device 10 to use trigonometry to allow user to aim exactly at a specific point.

In the preceding detailed description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The preceding detailed description, therefore, is not to be taken in a limiting sense, and the scope of the present invention is defined by the appended claims.

It is contemplated that features disclosed in this application, as well as those described in the above applications incorporated by reference, can be mixed and matched to suit particular circumstances. Various other modifications and changes will be apparent to those of ordinary skill.

The invention claimed is:

1. A method of putting a golf ball on a golf green towards a golf green cup, wherein the method comprises:

providing a putting alignment device comprising a pair of semi-circular arms and an elongated section that extends from the pair of semi-circular arms, wherein the semi-circular arms define a semi-circular recess that is adapted to receive a portion of the golf ball, wherein an alignment line is provided on the elongated section and wherein angular indicia are provided on opposite sides of the alignment line;

determining a speed of the green;

determining a distance between the golf ball and the golf green cup;

moving in a circle with respect to the golf green cup at a radius that is about equal to the distance;

determining an uphill location on the circle of a straight uphill direction;

determining a downhill location on the circle of a straight uphill direction;

determining a first cross putt location on the circle in a first direction of about 90 degrees from the uphill location;

determining a second cross putt location on the circle in a second direction of about 90 degrees from the uphill location, wherein the second direction is opposite the first direction;

dividing the circle into 4 quadrants that are defined by a first line between the uphill location and the downhill location and a second line between the first cross putt location and the second cross putt location;

dividing each quadrant into at least 2 angular increments;

determining an angle based upon the number of the angular increment that most closely matches the location of the golf ball, the slope of the green and the determined speed of the green;

positioning the putting alignment device adjacent to the golf ball so that the semi-circular recess receives a portion of the golf ball;

aligning the putting alignment device at the angle; and putting the golf ball towards the golf green cup using the alignment line.

2. The method of claim 1, wherein the angular indicia are provided at angular increments over an angle of about 90 degrees.

3. The method of claim 1, wherein each of the angular indicia corresponds to 5 angular degrees.

4. The method of claim 3, wherein the angular indicia are provided in an equal number on opposite sides of the alignment line and wherein the angular indicia are provided in alternating lengths of long angular indicia and short angular indicia.

5. The method of claim 1, wherein the uphill location is determined by moving along an uphill portion the circle until an approximately equal weight is sensed by both of a person's feet and wherein the downhill location is determined by moving along a downhill portion of the circle until an approximately equal weight is sensed by both of the person's feet.

6. The method of claim 1, wherein the at least 2 angular increments comprises 2 angular increments and is suited for a beginning golfer.

7. The method of claim 1, wherein the at least 2 angular increments comprises 3 angular increments and is suited for an intermediate golfer.

8. The method of claim 1, wherein the at least 2 angular increments comprises 5 angular increments and is suited for a professional golfer.

9. The method of claim 1, wherein determining the speed of the golf green comprises:

moving in a green speed determining circle with respect to the golf green cup at a radius that is about 10 feet;

marking an uphill green speed determining location on the green speed determining circle of a straight uphill direction;

marking a downhill green speed determining location on the green speed determining circle of a straight downhill direction;

marking a cross putt green speed determining location on the green speed determining circle that is about 90 degrees in a direction from the uphill location;

determining a slope between the uphill green speed determining location and the golf green cup;

place the golf ball at the cross putt green speed determining location;

hitting the golf ball towards the golf green cup with a speed so that the golf ball will reach the golf green cup;

calculating a distance that the golf ball breaks from the direction between the cross putt green speed determining location and the golf green cup; and determining the speed of the golf green based upon the slope and the distance of the golf ball break.

10. The method of claim 1, wherein for every foot of distance between the putting alignment device and the golf green cup, the angle will move proportionate a distance from the golf green cup.

* * * * *